US009051522B2

(12) United States Patent
Jancker et al.

(10) Patent No.: US 9,051,522 B2
(45) **Date of Patent: *Jun. 9, 2015**

(54) GASIFICATION REACTOR

(75) Inventors: Steffen Jancker, Gummerbach (DE); Thomas Paul Von Kossak-Glowczewski, Gummersbach (DE); Joachim Wolff, Amsterdam (NL)

(73) Assignee: Shell Oil Company, Houston, TX (US)

( * ) Notice: Subject to any disclaimer, the term of this patent is extended or adjusted under 35 U.S.C. 154(b) by 276 days.

This patent is subject to a terminal disclaimer.

(21) Appl. No.: 11/947,654

(22) Filed: Nov. 29, 2007

(65) Prior Publication Data

US 2008/0172941 A1 Jul. 24, 2008

Related U.S. Application Data

(60) Provisional application No. 60/868,682, filed on Dec. 5, 2006.

(30) Foreign Application Priority Data

Dec. 1, 2006 (EP) ..... 06125234

(51) Int. Cl.

| | |
|---|---|
| ***B01J 7/00*** | (2006.01) |
| ***C10B 49/16*** | (2006.01) |
| ***C10J 3/48*** | (2006.01) |
| ***C10J 3/76*** | (2006.01) |

(Continued)

(52) U.S. Cl.

CPC .. *C10J 3/485* (2013.01); *C10J 3/76* (2013.01); *C10J 3/84* (2013.01); *C10J 3/845* (2013.01); *C10J 2200/09* (2013.01); *C10J 2200/152* (2013.01); *C10J 2300/093* (2013.01); *C10J 2300/0959* (2013.01); *C10J 2300/1687* (2013.01); *C10K 1/101* (2013.01)

(58) Field of Classification Search

None

See application file for complete search history.

(56) References Cited

U.S. PATENT DOCUMENTS

| | | | |
|---|---|---|---|
| 2,572,051 | A | 10/1951 | Parry |
| 2,896,927 | A | 7/1959 | Nagle et al. |

(Continued)

FOREIGN PATENT DOCUMENTS

| | | |
|---|---|---|
| BE | 448968 | 5/1942 |
| CA | 1168527 | 6/1984 |

(Continued)

OTHER PUBLICATIONS

"Shell Gasification Process" Oil and Gas Journal, Sep. 6, 1971 pp. 85-90.

(Continued)

*Primary Examiner* — Kaity Handal

(57) ABSTRACT

The invention comprises a gasification reactor which comprises a vessel having at its upper end a downwardly directed burner and a combustion chamber located in the upper half of the vessel. The wall of the combustion chamber comprises an arrangement of interconnected parallel arranged tubes running from a common lower arranged distributor to a higher arranged common header. The distributor is connected to a cooling water supply conduit and the header is connected to a steam discharge conduit. Both the steam discharge conduit and the water supply conduit are fluidly connected to a steam drum. The steam drum is provided with a supply conduit for fresh water and the steam drum is positioned at a higher elevation than the common header.

6 Claims, 2 Drawing Sheets

(51) Int. Cl.

| | |
|---|---|
| ***C10J 3/84*** | (2006.01) |
| ***C10K 1/10*** | (2006.01) |

(56) References Cited

U.S. PATENT DOCUMENTS

| | | | | | |
|---|---|---|---|---|---|
| 2,961,310 | A | * | 11/1960 | Steever | 48/206 |
| 3,290,894 | A | | 12/1966 | Tsao | |
| 3,537,977 | A | | 11/1970 | Smith, Jr. | |
| 3,684,689 | A | | 8/1972 | Patton et al. | |
| 3,988,421 | A | | 10/1976 | Rinaldi | |
| 4,054,424 | A | | 10/1977 | Staudinger et al. | |
| 4,165,274 | A | | 8/1979 | Kwant | 208/93 |
| 4,202,672 | A | | 5/1980 | Schuurman | |
| 4,218,423 | A | | 8/1980 | Robin et al. | 422/207 |
| 4,272,255 | A | * | 6/1981 | Coates | 48/63 |
| 4,272,256 | A | | 6/1981 | Mitsak | |
| 4,309,196 | A | * | 1/1982 | Vollhardt | 48/77 |
| 4,310,333 | A | | 1/1982 | Schmidt et al. | |
| 4,326,856 | A | * | 4/1982 | Muenger et al. | 48/206 |
| 4,328,007 | A | | 5/1982 | Rafael | |
| 4,343,626 | A | | 8/1982 | Peise et al. | 48/67 |
| 4,437,864 | A | | 3/1984 | Gorris et al. | |
| 4,442,800 | A | * | 4/1984 | Seifert et al. | 122/379 |
| 4,444,726 | A | | 4/1984 | Crotty, Jr. et al. | 422/207 |
| 4,466,808 | A | | 8/1984 | Koog | 48/197 R |
| 4,473,033 | A | * | 9/1984 | Strohmeyer, Jr. | 122/4 D |
| 4,474,584 | A | * | 10/1984 | Koog | 48/197 R |
| 4,476,683 | A | | 10/1984 | Shah et al. | |
| 4,494,963 | A | | 1/1985 | Reich | |
| 4,510,874 | A | | 4/1985 | Hasenack | |
| 4,523,529 | A | | 6/1985 | Poll | 110/263 |
| 4,525,175 | A | | 6/1985 | Stellaccio | 48/86 R |
| 4,525,176 | A | | 6/1985 | Koog et al. | |
| 4,605,423 | A | | 8/1986 | Koog | |
| 4,624,683 | A | | 11/1986 | Dach | |
| 4,666,463 | A | | 5/1987 | Stellaccio | 48/197 R |
| 4,705,542 | A | | 11/1987 | Gilmer | 55/93 |
| 4,731,097 | A | | 3/1988 | Kohnen et al. | |
| 4,775,392 | A | | 10/1988 | Cordier et al. | |
| 4,778,483 | A | | 10/1988 | Martin et al. | 48/69 |
| 4,801,306 | A | | 1/1989 | Denbleyker | |
| 4,801,307 | A | | 1/1989 | Muenger et al. | |
| 4,808,197 | A | | 2/1989 | Ayers | |
| 4,809,625 | A | * | 3/1989 | Garcia-Mallol et al. | 110/347 |
| 4,818,252 | A | | 4/1989 | Kohnen et al. | |
| 4,818,253 | A | | 4/1989 | Kohnen et al. | |
| 4,818,423 | A | | 4/1989 | Steinbach et al. | 252/49.6 |
| 4,828,578 | A | | 5/1989 | Den Bleyker | 58/69 |
| 4,828,580 | A | | 5/1989 | Dach | |
| 4,852,997 | A | | 8/1989 | Segerstrom et al. | 48/210 |
| 4,859,213 | A | | 8/1989 | Segerstrom | |
| 4,863,489 | A | * | 9/1989 | Suggitt | 48/197 R |
| 4,880,438 | A | | 11/1989 | Den Bleyker | 48/69 |
| 4,887,962 | A | | 12/1989 | Hasenack et al. | |
| 4,936,871 | A | | 6/1990 | Wilmer et al. | |
| 4,973,337 | A | | 11/1990 | Jokisch et al. | |
| 4,992,081 | A | | 2/1991 | Den Bleyker | |
| 5,069,755 | A | | 12/1991 | Durr et al. | 202/169 |
| 5,133,941 | A | | 7/1992 | Hays et al. | 422/140 |
| 5,152,976 | A | | 10/1992 | Fong et al. | |
| 5,248,316 | A | | 9/1993 | Peise et al. | |
| 5,271,243 | A | | 12/1993 | Jelich | |
| 5,293,843 | A | * | 3/1994 | Provol et al. | 122/4 D |
| H1325 | H | * | 7/1994 | Doering et al. | 48/197 R |
| 5,415,673 | A | | 5/1995 | Hilton et al. | |
| 5,513,599 | A | * | 5/1996 | Nagato et al. | 122/4 D |
| 5,534,659 | A | | 7/1996 | Springer et al. | |
| 5,553,571 | A | * | 9/1996 | Campbell et al. | 122/379 |
| 5,570,645 | A | * | 11/1996 | Garcia-Mallol | 110/245 |
| 5,755,838 | A | | 5/1998 | Tanaka et al. | |
| 5,803,937 | A | | 9/1998 | Hartermann et al. | |
| 5,958,365 | A | | 9/1999 | Liu | 423/655 |
| 5,968,212 | A | | 10/1999 | Peise et al. | 48/101 |
| 5,976,203 | A | | 11/1999 | Deeke et al. | |
| 6,283,048 | B1 | | 9/2001 | Fujinami et al. | |
| 6,311,629 | B1 | | 11/2001 | Marschner et al. | |
| 6,312,482 | B1 | | 11/2001 | James et al. | |
| 6,453,830 | B1 | | 9/2002 | Zauderer | |
| 6,562,102 | B1 | | 5/2003 | Kepplinger et al. | |
| 6,702,936 | B2 | | 3/2004 | Retter et al. | 208/86 |
| 6,755,980 | B1 | | 6/2004 | van den Born et al. | |
| 6,808,653 | B1 | | 10/2004 | Muller et al. | |
| 7,037,473 | B1 | | 5/2006 | Donner et al. | 422/242 |
| 7,090,707 | B1 | * | 8/2006 | Barot | 48/113 |
| 7,163,647 | B2 | | 1/2007 | Sanfilippo et al. | |
| 7,587,995 | B2 | | 9/2009 | Kraft et al. | |
| 8,048,178 | B2 | | 11/2011 | Smit et al. | |
| 8,052,864 | B2 | | 11/2011 | Eilers et al. | |
| 2001/0020346 | A1 | | 9/2001 | Schingnitz et al. | 48/127.9 |
| 2006/0070383 | A1 | | 4/2006 | Drnevich et al. | |
| 2006/0076272 | A1 | | 4/2006 | Stil | |
| 2006/0105278 | A1 | * | 5/2006 | Katayama | 431/11 |
| 2006/0260192 | A1 | | 11/2006 | Barot | |
| 2007/0011945 | A1 | | 1/2007 | Grootveld et al. | 48/197 R |
| 2007/0062117 | A1 | | 3/2007 | Schingnitz et al. | 48/210 |
| 2007/0079554 | A1 | | 4/2007 | Schingnitz et al. | |
| 2007/0119577 | A1 | | 5/2007 | Kraft et al. | |
| 2007/0137107 | A1 | | 6/2007 | Barnicki | |
| 2007/0272129 | A1 | | 11/2007 | Schilder | |
| 2007/0294943 | A1 | | 12/2007 | van den Berg et al. | |
| 2008/0005966 | A1 | | 1/2008 | Fischer et al. | |
| 2008/0141588 | A1 | | 6/2008 | Kirchhubel et al. | |
| 2008/0172941 | A1 | | 7/2008 | Jancker et al. | |
| 2008/0222955 | A1 | * | 9/2008 | Jancker et al. | 48/67 |
| 2010/0140817 | A1 | * | 6/2010 | Harteveld et al. | 261/112.1 |
| 2010/0143216 | A1 | * | 6/2010 | Ten Bosch et al. | 422/207 |

FOREIGN PATENT DOCUMENTS

| | | | | |
|---|---|---|---|---|
| CA | 2658157 | | 1/2008 | |
| CN | 85104027 | A | 11/1986 | |
| CN | 86103455 | | 11/1986 | |
| CN | 1209447 | | 3/1999 | |
| CN | 1639306 | | 7/2005 | |
| CN | 1639306 | A | 7/2005 | |
| DE | 2425962 | | 5/1974 | |
| DE | 2342079 | | 3/1975 | C10J 3/48 |
| DE | 2935754 | | 6/1980 | F23D 1/00 |
| DE | 3009850 | | 9/1981 | B01J 3/04 |
| DE | 3809313 | | 3/1988 | |
| DE | 19643258 | | 4/1998 | C10J 3/74 |
| DE | 19829385 | | 10/1999 | C10J 3/48 |
| DE | 19952754 | | 5/2001 | C10K 1/04 |
| DE | 19957696 | | 5/2001 | C10J 3/56 |
| DE | 10004138 | | 8/2001 | |
| DE | 200317461 | | 8/2004 | F02D 41/20 |
| EP | 24281 | | 3/1981 | C10J 3/48 |
| EP | 127878 | | 8/1988 | C10J 3/48 |
| EP | 291111 | | 11/1988 | C01B 3/36 |
| EP | 160424 | | 8/1989 | C10J 3/48 |
| EP | 0379022 | | 1/1990 | |
| EP | 129737 | | 4/1990 | C10J 3/48 |
| EP | 0374323 | | 6/1990 | |
| EP | 400740 | | 12/1990 | |
| EP | 168128 | | 3/1991 | C01B 3/50 |
| EP | 416242 | | 3/1991 | |
| EP | 545281 | | 6/1993 | C10J 3/48 |
| EP | 551951 | | 7/1993 | |
| EP | 662506 | | 7/1995 | |
| EP | 683218 | | 11/1995 | C10G 67/04 |
| EP | 759886 | | 3/1997 | C01B 3/36 |
| EP | 0926441 | | 6/1999 | |
| EP | 1373441 | | 10/2002 | C10J 3/84 |
| EP | 926441 | | 12/2002 | |
| EP | 1450028 | | 12/2003 | |
| EP | 1499418 | | 1/2006 | |
| GB | 1413996 | | 11/1972 | C10G 9/48 |
| JP | 2003522020 | | 1/2001 | |
| JP | 2004518479 | | 7/2002 | |
| JP | 2005002306 | A | 1/2005 | |
| JP | 2005230622 | | 9/2005 | |
| JP | 2005531673 | A | 10/2005 | |
| SU | 839442 | | 6/1981 | |
| SU | 917700 | | 3/1982 | |

(56) References Cited

FOREIGN PATENT DOCUMENTS

| | | | | |
|---|---|---|---|---|
| SU | 1745990 | | 7/1992 | |
| WO | 9317759 | | 9/1993 | |
| WO | 9532148 | A1 | 11/1995 | |
| WO | WO9532148 | | 11/1995 | ..... C01B 3/36 |
| WO | WO9603345 | | 2/1996 | ..... C01B 3/36 |
| WO | WO9639354 | | 12/1996 | ..... C01B 3/36 |
| WO | WO9722547 | | 6/1997 | ..... C01B 3/36 |
| WO | WO9925648 | | 5/1999 | |
| WO | 02079351 | | 10/2002 | |
| WO | 2004005438 | | 1/2004 | |
| WO | 2005025095 | | 3/2005 | |
| WO | 2007125046 | | 11/2007 | |
| WO | 2008065184 | | 6/2008 | |
| WO | 2008110592 | | 9/2008 | |
| WO | 2008113766 | | 9/2008 | |

OTHER PUBLICATIONS

Kuhre et al; "Partial Oxidation Grows Stronger in US"; Oil and Gas Journal vol. 69, No. 36; pp. 86-90; Sep. 6, 1971.

* cited by examiner

GASIFICATION REACTOR

This application claims the benefit of U.S. Provisional Application No. 60/868,682 filed Dec. 5, 2006 and European Application No. 06125234.2 filed Dec. 1, 2006, both of which are incorporated by reference.

BACKGROUND

The following invention is directed to a gasification reactor vessel, provided at its upper end with a downwardly directed burner, provided with supply conduits for an oxidizer gas, a carbonaceous feed and a moderator gas, a combustion chamber in the upper half of the vessel provided with a product gas outlet at its bottom end and an opening for the outlet of the burner at its top end.

EP-A-168128 describes a gasification reactor provided at its upper end with a downwardly directed burner. The reactor is also provided with a combustion chamber. The combustion chamber is made up from a refractory grade lining. A product gas outlet at the bottom end of the combustion chamber is fluidly connected with a diptube, which diptube is partly submerged in a water bath located at the lower end of the reactor vessel. In use solids, including particles of ash, char and unconverted carbonaceous feed are removed from the product gas by contact with the water bath. The solids are removed from the reactor via a valve located at the bottom of the reactor.

U.S. Pat. No. 5,968,212 describes a gasification reactor provided at its upper end with a downwardly directed burner. The reactor is also provided with a combustion chamber. The combustion chamber is made up from a refractory grade lining. The product gas leaving the opening in the lower end of the combustion chamber may enter a lower part of the reactor which part is provided with a waste heat boiler.

A problem with the above reactors is that the refractory lining has a short life time. Especially under the high temperature conditions and when ash containing feeds are gasified. The temperature issue may be addressed by cooling the interior of the combustion wall. The below publications describe various manners how this is achieved.

U.S. Pat. No. 7,037,473 describes a gasification reactor provided at its upper end with a downwardly directed burner. The reactor is also provided with a combustion chamber. The wall of the combustion chamber is cooled by cooling water which flows through a spirally wound conduit within the wall of the combustion chamber.

US-A-2001/0020346 discloses a gasification reactor provided at its upper end with a downwardly directed burner. The reactor is also provided with a combustion chamber. The wall of the combustion chamber comprises an arrangement of vertical and parallel-arranged tubes placed on the interior of the reactor wall. The tubes run from a common lower arranged distributor to a higher arranged common header, the distributor is provided with a cooling water supply conduit and the header is provided with a discharge conduit for warm water or steam.

A problem with a water-cooled wall of the combustion chamber is that it is sensitive to process upsets. For example in case no fresh water is supplied to the cooling conduits overheating will damage the conduits.

The present invention provides a solution for the above problem.

SUMMARY OF THE INVENTION

The present invention provides a gasification reactor vessel (1), provided at its upper end with a downwardly directed burner (2), provided with supply conduits for an oxidizer gas (3), a carbonaceous feed (4) and a moderator gas (5), a combustion chamber (6) in the upper half of the vessel, provided with a product gas outlet (7) at its bottom end and an opening for the outlet of the burner (2) at its top end, wherein between the wall of the combustion chamber (6) and the wall of vessel (1) an annular space (9) is provided, and wherein the wall of the combustion chamber comprises an arrangement of interconnected parallel arranged tubes resulting in a substantially gas-tight wall running from a common lower arranged distributor to a higher arranged common header, said distributor provided with a cooling water supply conduit and said header provided with a steam discharge conduit and wherein the steam discharge conduit and the water supply conduit are fluidly connected to a steam drum and wherein the steam drum is provided with a supply conduit for fresh water and wherein the steam drum is positioned at a higher elevation than the common header.

DETAILED DESCRIPTION

Figure 1:
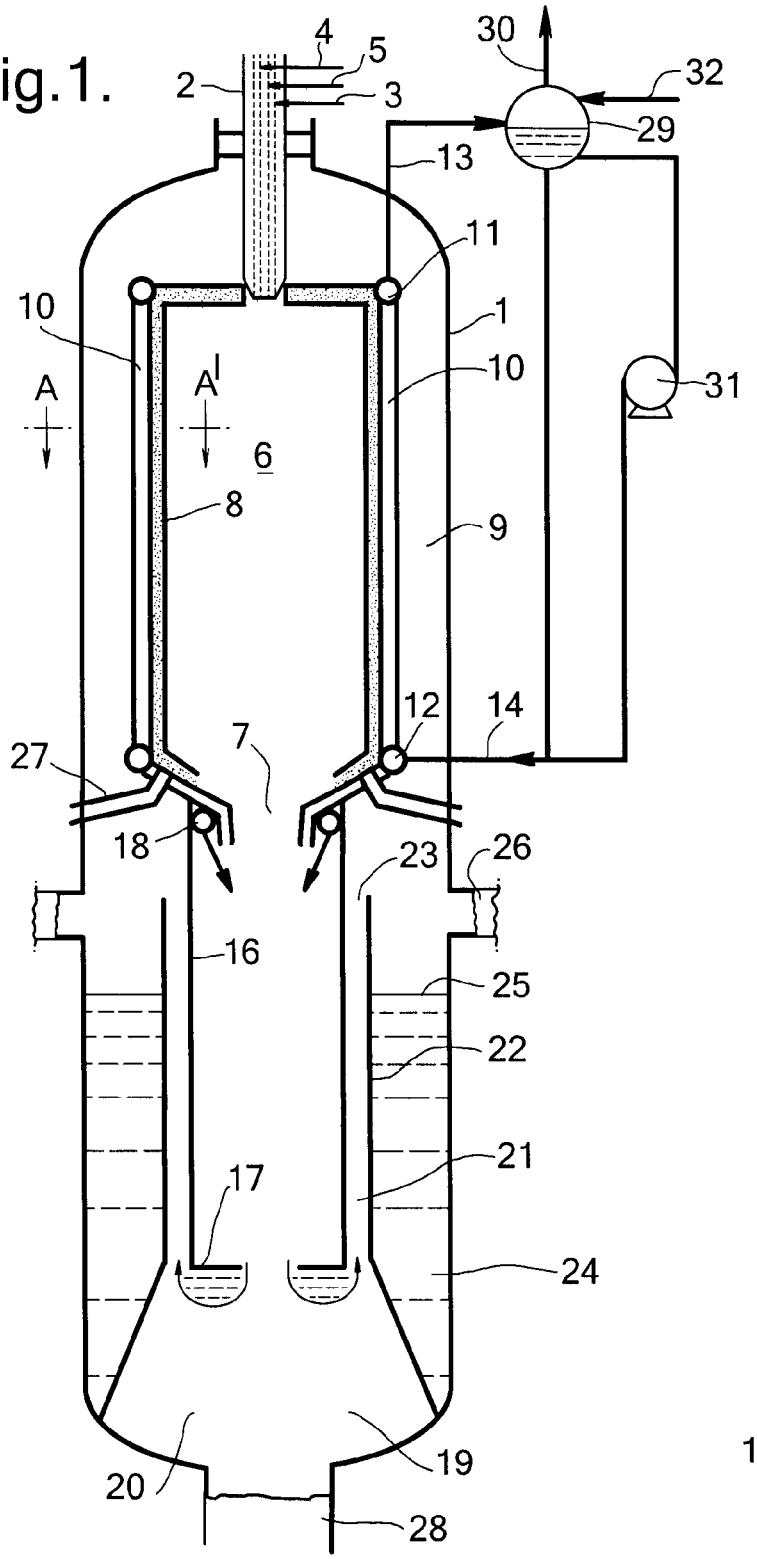
FIG. 1 shows a preferred gasification reactor according to the present invention.

Applicants found that by cooling the combustion wall with evaporating steam using the apparatus as claimed, a reactor is provided which retains its cooling capacity even in the event that no fresh cooling water is added to the steam drum. Because the steam drum is located at a higher elevation than the common header water as present in the steam drum will flow due to gravity to the common distributor of the gasification reactor. An additional advantage is that steam is produced which can be advantageously used for other applications in a process, which incorporates the gasification reactor. Such applications are process steam for optional downstream shift reactions, heating medium for an optional liquid carbonaceous feed or, after external superheating, as moderator gas in the burner. A more energy efficient process is so obtained.

The gasification reactor is preferably further provided with water pumping means to enhance the flow of water from the steam drum to the distributor. In case of an upset of either this pump or in the supply of fresh water to the steam drum the liquid water as present in the elevated steam drum will still flow due to the force of gravity to the common distributor. The elevation of the steam drum is defined by the water level as normally present in the steam drum. The volume of water in the steam drum is preferably sufficient to ensure at least one minute of cooling of the combustion chamber wall. The maximum volume of water will in practice not exceed a volume required for 60 minutes of cooling. The invention is also directed to a process to prepare a mixture of hydrogen and carbon monoxide by partial oxidation of a carbonaceous feed in a reactor according to the present invention wherein the volume of water present in the steam drum is sufficient to cool the wall of the combustion chamber for at least 1 minute in case the supply of fresh water is interrupted or wherein the volume of water present in the steam drum is sufficient to cool the wall of the combustion chamber for at least 1 minute in case the pumping means fail.

The gasification reactor according to the present invention may advantageously be used to prepare a mixture of carbon monoxide and hydrogen from an ash containing solid or liquid feed. The ash in the feed will cause the reactor to operate in a so-called slagging conditions wherein a layer of slag will form on the interior of the wall of the combustion chamber. This layer will flow very slowly to the product outlet opening of the combustion chamber and flow or fall downwardly towards the lower end of the reactor. The layer of slag will further protect the wall of the combustion chamber against the high temperatures in said chamber. In order to further protect the cooling conduits of the combustion chamber wall it is preferred to coat the inner wall of the combustion chamber with a layer of refractory material.

In the burner of the gasification reactor a carbonaceous feed is partially oxidized with an oxygen comprising gas, preferably in the presence of a moderator gas to prepare a mixture of carbon monoxide and hydrogen. The oxygen comprising gas may be enriched air or pure oxygen as especially obtained in an Air Separation Unit (ASU). With pure oxygen is meant oxygen having a purity of between 95 and 100 vol %. Moderator gas may be $CO_2$ or steam, preferably steam. More preferably the steam as prepared in the steam drum is used as moderator gas. Preferably this steam is first heated to obtain super heated steam before it is used as moderator gas. The superheating of the steam can take place in an external heater or alternatively in a part of the gasification reactor heating surface conduits as discussed below.

A solid and ash containing carbonaceous feed may be for example coal, brown coal, peat, wood, petroleum coke and soot. A solid carbonaceous feed may be provided to the burner of the reactor as a slurry in water. Coal slurry feeding processes are for example described in the afore mentioned EP-A-168128. Preferably the solid carbonaceous feed is provided to the burner in a gas-solids mixture comprising the solid feed in the form of a powder and a suitable carrier gas. Suitable carrier gasses are nitrogen, carbon dioxide or synthesis gas, i.e. a mixture comprising of CO and $H_2$. The density of this solids gas mixture is preferably from 200 to 500 kg/m$^3$, preferably from 250 to 475 kg/m$^3$, more preferably from 300 to 450 kg/m$^3$.

Nitrogen is commonly used as carrier gas because of its availability as a by-product of an Air Separation Unit (ASU). In some cases however it may be preferred to use carbon dioxide as the carrier gas. Especially when the mixture of carbon monoxide and hydrogen as prepared in the gasification reactor are used to prepare chemicals as for example methanol and dimethyl ether or as feedstock for a Fischer-Tropsch synthesis process. According to a preferred embodiment of the method according to the present invention, the weight ratio of $CO_2$ to the carbonaceous feed is less than 0.5 on a dry basis, more preferably in the range from 0.12-0.49, preferably below 0.40, even more preferably below 0.30, most preferably below 0.20 on a dry basis. The product gas as it leaves the combustion chamber will then preferably comprise from 1 to 10 mol % $CO_2$, preferably from 4.5 to 7.5 mol % $CO_2$ on a dry basis. The solid-carrier gas feed streams are contacted with an oxygen containing gas in a suitable burner. Examples of suitable burners and their preferred uses are described in described in U.S. Pat. No. 4,510,874 and in U.S. Pat. No. 4,523,529.

The carbonaceous feed may also be a liquid carbonaceous feed comprising ash, preferably between 0.1 and 10, more preferably between 0.1 and 4 wt % ash. Examples of such ash containing liquid feeds are the atmospheric or vacuum residual fractions as separated from a tar sands feed or more preferably the asphalt fraction as separated from said residual streams in a de-asphalting process.

The process is preferably performed in a reactor vessel as illustrated in FIG. 1. The Figure shows a gasification reactor vessel (1), provided at its upper end with a downwardly directed burner (2). Burner (2) is provided with supply conduits for the oxidizer gas (3), the carbonaceous feed (4) and optionally the moderator gas (5). The burner (2) is arranged at the top end of the reactor vessel (1) pointing with its outlet in a downwardly direction. The vessel (1) comprises a combustion chamber (6) in the upper half of the vessel provided with a product gas outlet (7) at its bottom end and an opening for the outlet of the burner (2) at its top end. Between the combustion chamber (6) and the wall of vessel (1) an annular space (9) is provided. The annular space (9) and the wall of the combustion chamber protects the outer wall of vessel (1) against the high temperatures within the combustion chamber (6).

The wall of the combustion chamber (6) comprises an arrangement of interconnected parallel arranged tubes (10) resulting in a substantially gas-tight wall. Such a wall is also referred to as a membrane wall. The tubes (10) run from a common lower arranged distributor (12) to a higher arranged common header (11). The distributor (12) is provided with a cooling water supply conduit (14). The header (11) is provided with a steam discharge conduit (13). The steam discharge conduit (13) and the water supply conduit (14) are fluidly connected to a steam drum (29). The steam drum (29) is provided with a supply conduit (32) for fresh water and an outlet conduit (30) for produced steam. As shown in the Figure the steam drum (29) is positioned at a higher elevation than the common header (11). A preferred water pump (31) is shown to enhance the flow of water from steam drum (29) to the distributor (12).

The tubes (10) are preferably coated with a refractory (8) in order to reduce the heat transfer to said tubes (10).

The bottom end of the combustion chamber may be open to a lower part of the gasification reactor which lower part is provided with an outlet for product gas. This lower part is preferably provided with means to cool the product gas from the elevated temperature of the combustion chamber. Such cooling means may be by indirect cooling in a waste heat boiler as shown in earlier referred to U.S. Pat. No. 5,968,212. Alternatively cooling may be achieved by injecting a cooling medium into the hot product gas as described in DE-A-19952754. More preferably cooling is achieved by quenching in a water bath. To enable quenching in a quenching zone (19) the outlet opening (7) of the combustion chamber (6) is preferably fluidly connected to a dip-tube (16). Dip-tube (16) is partly submerged in a water bath (20) located at the lower end of the reactor (1). Preferably at the upper end of the dip-tube (16) injecting means (18) are present to add a quenching medium to the, in use, downwardly flowing hot product gas, i.e. the mixture of hydrogen and carbon monoxide. The dip-tube is preferably vertically aligned with the combustion chamber and tubular formed.

The water quenching zone (19) is present in the pathway of the hot product gas as it is deflected at outlet (17) in an upwardly direction (see arrows) to flow upward through, an annular space (21) formed between an optional tubular shield (22) and dip-tube (16). In annular space (21) the synthesis gas will intimately contact the water in a quenching operation mode. The upper end (23) of the annular space is in open communication with the space (24) between dip-tube (16) and the wall of the gasification reactor (1). In space (24) a water level (25) will be present. Above said water level (25) one or more synthesis product outlet(s) (26) are located in the wall of reactor (1) to discharge the quenched product gas. Between space (24) and annular space (9) a separation wall (27) may optionally be present.

At the lower end of the gasification reactor (1) a slag discharge opening (28) is suitably present. Through this discharge opening (28) slag together with part of the water is charged from the vessel by well known slag discharge means, such as sluice systems as for example described in U.S. Pat. Nos. 4,852,997 and 6,755,9802.

The gasification reactor according to invention is preferably operated such that the hot product gas as is discharged from the outlet (7) has a temperature of between 1000 and 1800° C. and more preferably at a temperature between 1300 and 1800° C. The pressure in the combustion chamber and thus of the product gas is preferably between 0.3 and 12 MPa and preferably between 3 and 8 MPa. The temperature conditions are so chosen that the slag layer will create a layer and flow to a lower positioned slag outlet device in the reactor.

The quenching medium as provided via injecting means (18) is preferably water or steam or a combination of both. A mist of water may be applied wherein the mist is generated making use of an atomizing gas. Suitable atomizing gasses are steam or recycle product (synthesis) gas. The water may be fresh water. Optionally the water may be the process condensate of a optional downstream water shift unit. In a preferred embodiment a solids containing water may partly or wholly replace the fresh water. Preferably the solids containing water is obtained in the water quenching zone (19). Alternatively the solids containing water may be the bleed stream of a optional downstream water scrubbing unit (not shown). For example the bleed stream of the scrubber unit is used. The use of a solids containing water as here described has the advantage that water treatment steps may be avoided or at least be limited.

The temperature of the product gas after contacting the gas in the quench zone (19) as it is discharged from the reactor (1) at outlet (26) is preferably between 130 and 330° C.

Figure 2:
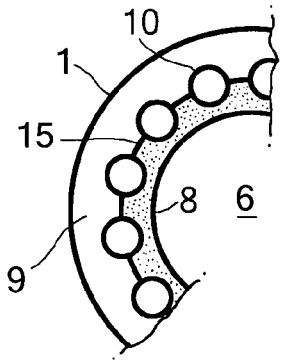
FIG. 2 is the cross-sectional view AA' of FIG. 1.

FIG. 2 shows part of reactor of FIG. 1. In this Figure it is seen that the cooling conduits (10) are interconnected by connecting parts (15) such that they form a gas-tight combustion chamber (6) within the refractory wall.

Figure 3:
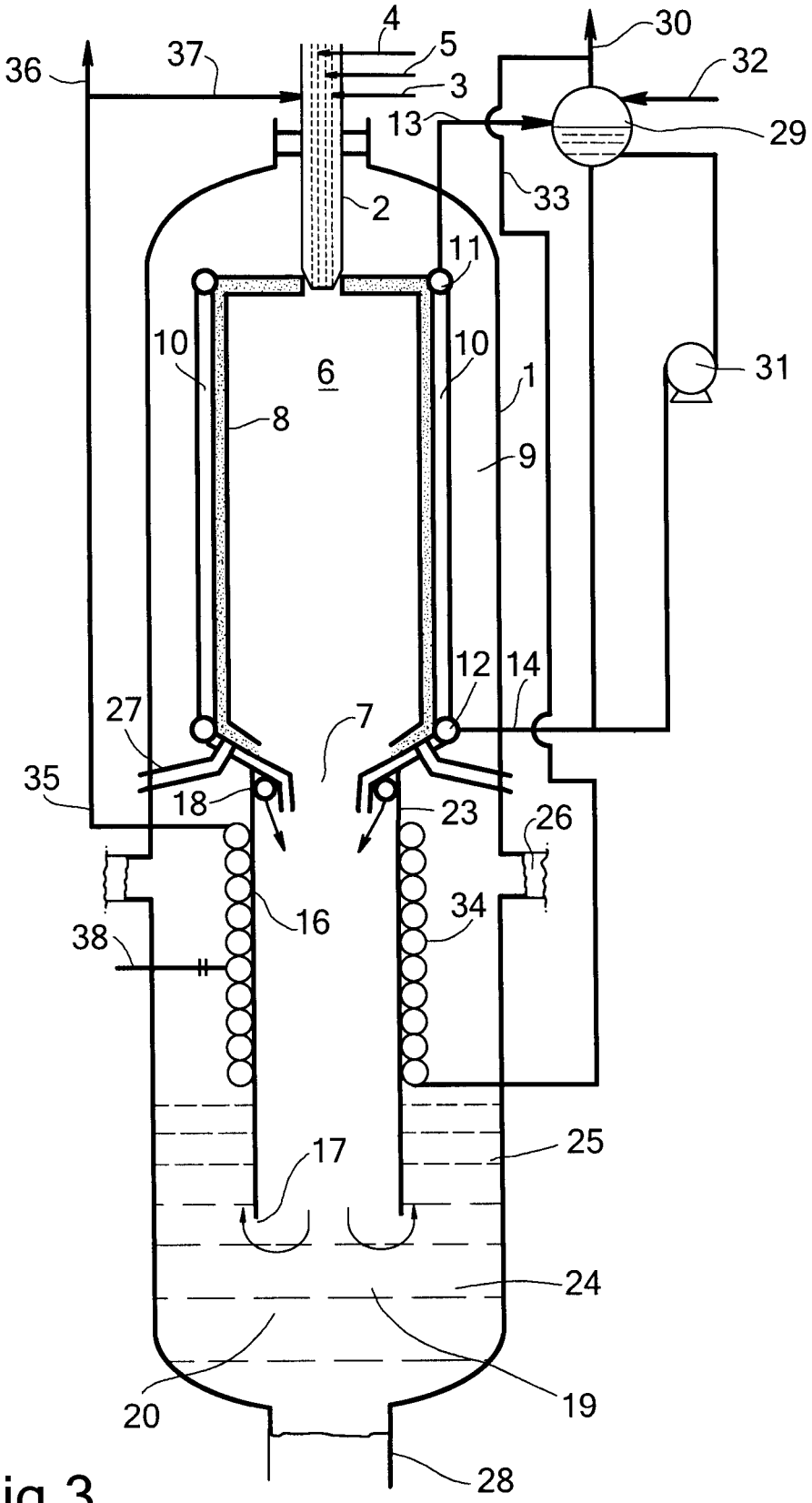
FIG. 3 shows a second embodiment of a gasification reactor.

FIG. 3 shows the reactor of FIG. 1 wherein shield (22) is omitted. The numerals used in this Figure have the same meaning as in FIG. 1. Means are present to cool the upper part of dip tube (16) in the form of a spirally wound tube (34) through which, in use, a cooling medium flows. Other designs, especially vertical arranged tubes through which a cooling medium flows, may also be contemplated. A suitable cooling medium is water. More preferably the cooling medium is the steam generated in drum (29). In such a preferred embodiment the tubes (34) serve as a super heater module to further increase the temperature of the steam generated in drum (29) to obtain super heated steam. For this embodiment, conduit (33) is shown which fluidly connects steam drum (29) with the inlet of the tube (34). Further a discharge tube (35) is shown to discharge the super heated steam. In FIG. 2 is also shown that the super heated steam may be used as moderator gas via conduit (37) or discharged for other uses (36). Other uses may be power generation. The moderator gas (37) may be mixed with the oxidizer gas or supplied separately to the burner (2) in case a solid feed is used. The moderator gas is preferably supplied separately when a liquid feed is used.

Preferably the tubes (34) are provided with mechanical cleaning devices (38) to keep the surface of the tubes (34) free from slag and fouling. Injecting means (18) may be arranged at the top of the part made of tubes (34), as shown, or just below this part made of tubes (34) or a combination of both.

The invention claimed is:

1. A gasification reactor comprising:

a vessel having a wall and provided at its upper end with a downwardly directed burner, and provided with supply conduits for an oxidizer gas, a carbonaceous feed and a moderator gas, a combustion chamber having a wall and located in the upper half of the vessel, provided with a product gas outlet at its bottom end and an opening for the outlet of the burner at its top end, wherein between the wall of the combustion chamber and the wall of the vessel an annular space is provided, and wherein the wall of the combustion chamber comprises an arrangement of interconnected parallel arranged tubes resulting in a substantially gas-tight wall, having an inner side and an outer side, running from a common lower arranged distributor to a higher arranged common header, said distributor provided with a cooling water supply conduit and said header provided with a steam discharge conduit and wherein the steam discharge conduit and the water supply conduit are fluidly connected, at a higher elevation from the base, to a steam drum, the steam drum being located at a higher elevation than the common header, and wherein the steam drum is provided with a supply conduit for fresh water;

wherein the tubes comprise a coating comprising a refractory material, the tubes being interconnected by connecting parts such that they form a gas-tight combustion chamber within the refractory wall;

wherein the product gas outlet at the bottom end of the combustion chamber is fluidly connected to a dip-tube, which is partly submerged in a water bath located at the lower end of the reactor vessel; and wherein the upper part of the dip tube is provided with vertical arranged tubes or a spirally wound tube through which, in use, cooling water or steam may flow.

2. A reactor according to claim 1, wherein a water pump is present to enhance the flow of water from the steam drum to the distributor.

3. A reactor according to claim 1, wherein at the upper end of the dip-tube injecting means are provided to add a quenching medium to the, in use, downwardly flowing mixture of hydrogen and carbon monoxide.

4. A reactor according to claim 1, wherein at the lower end of the reactor vessel a slag discharge opening is present to discharge slag from the reactor vessel.

5. A reactor according to claim 1, further comprising a steam conduit connecting the steam drum to the downwardly directed burner, wherein the moderator gas comprises steam provided from the steam drum.

6. A reactor according to claim 1, wherein the dip-tube is surrounded by a tubular shield.

* * * * *